US010517417B2

(12) United States Patent
Kutas et al.

(10) Patent No.: US 10,517,417 B2
(45) Date of Patent: Dec. 31, 2019

(54) CURBSIDE MAILBOX WITH CONVENIENT BOX HANDLING FEATURES

(71) Applicants: Jeffrey Robert Kutas, Granbury, TX (US); Brian Lang, Poolville, TX (US)

(72) Inventors: Jeffrey Robert Kutas, Granbury, TX (US); Brian Lang, Poolville, TX (US)

( * ) Notice: Subject to any disclaimer, the term of this patent is extended or adjusted under 35 U.S.C. 154(b) by 0 days.

(21) Appl. No.: 16/003,815

(22) Filed: Jun. 8, 2018

(65) Prior Publication Data

US 2018/0352987 A1 Dec. 13, 2018

Related U.S. Application Data

(60) Provisional application No. 62/518,109, filed on Jun. 12, 2017.

(51) Int. Cl.

| | |
|---|---|
| ***A47G 29/12*** | (2006.01) |
| ***A47G 29/14*** | (2006.01) |
| ***A47G 29/16*** | (2006.01) |
| ***A47G 29/22*** | (2006.01) |

(52) U.S. Cl.

CPC ... *A47G 29/12095* (2017.08); *A47G 29/1214* (2013.01); *A47G 29/141* (2013.01); *A47G 29/16* (2013.01); *A47G 29/22* (2013.01); *A47G 2029/145* (2013.01); *A47G 2029/148* (2013.01)

(58) Field of Classification Search

CPC ..... A47G 29/12095; A47G 29/12097; A47G 29/1251; A47G 29/22; A47G 29/1214; A47G 29/141; A47G 29/124; A47G 2029/149

USPC ..... 232/17, 19, 29, 45, 47, 51, 34–36

See application file for complete search history.

(56) References Cited

U.S. PATENT DOCUMENTS

| | | | | |
|---|---|---|---|---|
| 4,757,942 | A | 7/1988 | Young, Jr. | |
| 5,137,212 | A * | 8/1992 | Fiterman | B65F 1/10 109/46 |
| 5,435,484 | A * | 7/1995 | Carlson | A47G 29/1251 232/47 |
| 5,449,111 | A | 9/1995 | Sauzedde et al. | |
| 5,938,113 | A * | 8/1999 | Kim | A47G 29/1209 232/17 |
| 6,375,071 | B1 * | 4/2002 | Kim | A47G 29/1209 232/33 |
| 6,378,767 | B1 * | 4/2002 | Steele | A47G 29/22 232/19 |
| 6,483,433 | B2 | 11/2002 | Moskowitz et al. | |

(Continued)

*Primary Examiner* — William L Miller

(74) *Attorney, Agent, or Firm* — Optima Law Group, APC; Thomas E. Jurgensen; Craig W. Barber

(57) ABSTRACT

The present invention teaches a residential curbside mailbox with enhanced box handling capability, openable by barcode scanning, and with interchangeable bonnets. A body which is generally column shaped has front and rear doors which open at the top and hinge near the bottom and which have interleaved fingers or members extending from the bottom ends into the interior space of the mailbox. A box tray sits on the interleaved fingers. When either door is opened the fingers of that door lift the box tray upward and out of the box on that side. Thus a delivery person may access a box without leaving a delivery vehicle, while the homeowner may do the same without leaving the safety of the yard. In addition, an elastic cord and carefully slanted slots on side panels of the front door allow easy retention of a box even further up the front door.

17 Claims, 8 Drawing Sheets

(56) References Cited

U.S. PATENT DOCUMENTS

| | | | | |
|---|---|---|---|---|
| 6,879,255 | B1 | 4/2005 | Jezierski | |
| 6,987,452 | B2 | 1/2006 | Yang | |
| 7,123,147 | B2 | 10/2006 | Engel | |
| 7,252,220 | B1 * | 8/2007 | Shreve | A47G 29/1216 232/29 |
| 7,320,427 | B2 * | 1/2008 | Prestwich | A47G 29/16 232/45 |
| 7,337,944 | B2 | 3/2008 | Devar | |
| 7,516,880 | B1 | 4/2009 | Crain et al. | |
| 7,843,340 | B2 | 11/2010 | Davis | |
| 7,854,374 | B2 | 12/2010 | Dudley | |
| 7,946,472 | B2 * | 5/2011 | Bolles | A47G 29/22 109/68 |
| 8,261,966 | B2 | 9/2012 | Cox et al. | |
| 8,299,923 | B2 | 10/2012 | Hammoud | |
| 8,573,473 | B1 * | 11/2013 | Farentinos | A47G 29/22 232/45 |
| 2004/0211827 | A1 * | 10/2004 | Gunvaldson | A47G 29/1209 232/19 |
| 2008/0067227 | A1 | 3/2008 | Poss et al. | |
| 2010/0127063 | A1 * | 5/2010 | Bolles | A47G 29/22 232/39 |
| 2011/0210166 | A1 | 9/2011 | Dinh | |
| 2013/0020384 | A1 | 1/2013 | Corey | |
| 2015/0021386 | A1 * | 1/2015 | Farentinos | A47G 29/22 232/43.3 |
| 2017/0156533 | A1 | 6/2017 | Pajonas | |

* cited by examiner

Figure 3
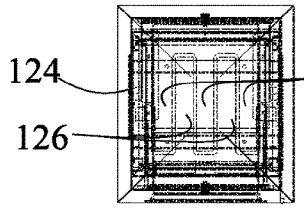
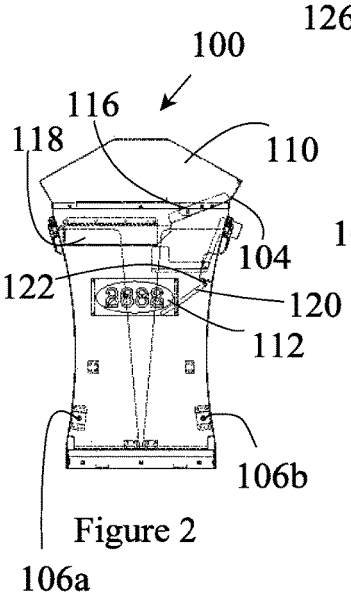
Figure 2
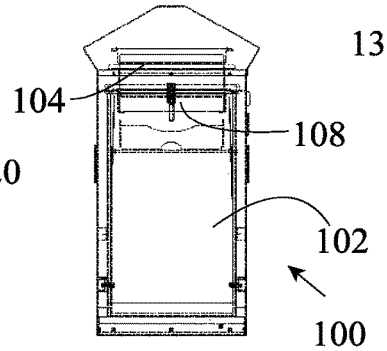
Figure 1
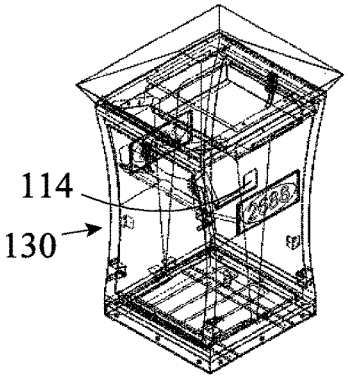
Figure 4

CURBSIDE MAILBOX WITH CONVENIENT BOX HANDLING FEATURES

RELATED APPLICATION(S)

This application claims the benefit of U.S. patent application Ser. No. 62/518,109 filed Jun. 12, 2017 in the name of the inventor, Jeffrey Robert Kutas.

FIELD OF THE INVENTION

The present invention relates generally to mailboxes and more specifically to curbside mailboxes with expanded box handling features and convenience features.

BACKGROUND

Residential home mailboxes of the curbside type generally are either arranged for the convenience of an individual in a motor vehicle, and have a door which opens toward the front or street side, or else are arranged for the convenience of an individual on the sidewalk and have the door open toward the back or sidewalk side.

The natural result is that homeowners in exurban and rural areas often end up checking their own mailbox from their car. However, since the driver's wheel of a motor vehicle is on the left side of the car and since the car is legally required to remain facing so that the car is on the right side of the road, the driver is in fact still required to leave their vehicle to tend the mailbox. This is an obvious source of danger for the homeowner/driver. Note that some mail delivery vehicles (such as the Grumman® vans) are actually arranged with the driver's wheel on the right side so that the mail delivery person is seated on the curbside of the van and can use such mailboxes easily, but in general normal US passenger vehicles all have the driver's wheel on the side of the car nearest the center of the road.

Homeowners of curbside mailboxes experience other problems. One very common issue, especially in the age of constant on-line ordering, is the irritation surrounding return of packages which do not fit in the standard size of curbside mailbox. A purchaser who wishes to return a product via mail will have to go online, get a mailing label from the seller, and then notify the mail delivery person (via a note on the curbside box or whatever) that they have a box which needs to be returned.

It would be preferable to provide a residential home mailbox which works equally well for a person in a vehicle or a person standing on the sidewalk/boulevard.

It would further be preferable to provide a residential home mailbox which allows a mail delivery person to access packages within the box without need for a special key.

US Patent Application Publication No. 2008/0067227, published Mar. 20, 2008 in the name of Poss et al, teaches a package deposit enclosure for public use, not residential use. It lacks the ability to lift packages in either direction when opened, to scan barcodes for entry and modular renovation and improvement.

U.S. Pat. No. 8,261,966 issued Sep. 11, 2012 in the name of Cox et al, teaches a residential mailbox having a column style mailbox with various doors and supports but no indication of easy renovation and modular improvement.

U.S. Pat. No. 7,854,374 issued Dec. 21, 2010 in the name of Dudley, teaches at least multiple mail handling compartments and multiple doors for convenient access in different ways. However, it lacks the ability to lift packages from the bottom for easy handling from either side.

U.S. Pat. No. 6,987,452 issued Jan. 17, 2006 in the name of Yang teaches an "iBox", an intelligent mailbox having communication capabilities but lacking basic mail handling functions, the ability to be easy accessed from either curbside or sidewalkside, does not cooperate with barcodes and so on.

U.S. Pat. No. 6,879,255 issued Apr. 12, 2005 in the name of Jezierski teaches a mailbox cam retrofit to a traditional mailbox, which transmits an image from the box, but which lacks security features for the homeowner's security (rather than just box security), and does not teach any usability with bar codes, lacks a scanner, lacks convenience features for the curbside/sidewalkside problem and so on.

U.S. Pat. No. 6,483,433 issued Nov. 19, 2002 in the name of Moskowitz et al teaches a computer system for determining if a package has been placed in a depository, but lacks any physical mail box structure.

It would be preferable to provide a mail box which has none of these limitations.

It would further be preferable to provide a mail box which can be easily semi-customized or renovated in a modular manner to a higher level of structural features and capabilities.

SUMMARY OF THE INVENTION

The present invention teaches a residential curbside mailbox with enhanced box handling capability, openable by barcode scanning, and with interchangeable bonnets.

A body which is generally column-shaped has front and rear sides having respective front and rear doors which open at the top and hinge near the bottom. A bonnet caps the columnar body.

The front and rear doors have interleaved fingers or members extending from the bottom ends into the interior space of the mailbox. A box tray sits on the interleaved fingers. The center of gravity of the box tray sit within the ambit of both sets of interleaved fingers/members, so either set of fingers can provide stable support for the box tray without the other set of fingers. When either door is opened the fingers of that door lift the box tray upward and out of the box on that side. Thus a delivery person may access a box without leaving a delivery vehicle, while the homeowner may do the same without leaving the safety of the yard.

In addition, an elastic cord and carefully slanted slots on side panels of the front door allow easy retention of a box even further up the front door. The elastic cord is attached to fasteners which ride in two slots which are angled relative to the vertical axis of the column and which are cut through side panels of the front door. The side panels sit within the columnar body when the front door is closed. A package may be suspended on the vertical interior side of the front door by placing it within the elastic, which will then hold it by friction against the interior of the front door. When the front door is opened the package is moved even further outward and upward than if it were on the box tray. When the package is removed, the slanted slots of the side panels of the door allow the fasteners to slide closer to the top of the door and thus make it even easier to remove the package from the elastic loop suspending it. In addition, the side panels of the front door are not exactly perpendicular to the front door itself, being slightly slanted inward. Thus the angle made by the panels and door may be 80 degrees or 85 degrees or so on, rather than exactly 90 degrees. This slight inward camber allows the fasteners to slide even more easily.

A letter slot in the bonnet of the mailbox may allow letters to fall to a slanted chute which in turn allows the letters to slide downward into a letter drawer which may be easily withdrawn via the rear door of the mailbox.

In addition, the invention may also have interchangeable bonnets, the top of the column which prevents rain from entering the mailbox and has the letter slot to allow the letters to be deposited in the mailbox as described in the previous paragraph. For example, the bonnet may have a solar cell powering a house number light or an interior light for the box. The bonnet may contain machinery including a scanner and solenoid operative to scan a bar code and then open the front door if the bar code is correct. The bonnet machinery may also be connected to a home safety system such as a "First Alert"® elder monitor system or a home security system, and when activated, may turn on the exterior light on the mailbox, thus alerting returning home owners that their house has been broken into, or more easily alerting first responders such as ambulance drivers responding to a First Alert® call as to exactly which house is the correct house. An external camera may provide extra security and an internal camera may send a text message with an image of the interior of the mailbox so the home owner will know what is in the mailbox.

These, and other, embodiments of the invention will be better appreciated and understood when considered in conjunction with the following description and the accompanying drawings. It should be understood, however, that the following description, while indicating various embodiments of the invention and numerous specific details thereof, is given by way of illustration and not of limitation. Many substitutions, modifications, additions and/or rearrangements may be made within the scope of the invention without departing from the spirit thereof, and the invention includes all such substitutions, modifications, additions and/or rearrangements.

SUMMARY IN REFERENCE TO THE CLAIMS

It is therefore a first aspect, advantage, objective and embodiment of the present invention to provide a residential mailbox comprising: a columnar body having a vertical axis and a front; the front having a front door therein, the front door forming part of the front when in a closed position, the front door having at least one hinge allowing it to move to an open position by swinging outward at a top end; the front door having two side panels, the side panels concealed within the columnar body in the closed position, each side panel having a respective slot therethough, each slot being oriented at an angle to the vertical axis when in the closed position; an elastic member having two ends, each end having a respective fastener thereon, each fastener sliding within one slot whereby the elastic member is suspended loosely between the two slots and may move along the slots.

It is therefore a second aspect, advantage, objective and embodiment of the present invention to provide a residential mailbox, the side panels further comprising: a relative angle between the front door and the side panels of slightly less than 90 degrees.

It is therefore another aspect, advantage, objective and embodiment of the present invention to provide a residential mailbox, further comprising: a first bonnet secured atop the columnar body, the first bonnet having a first letter delivery slot on a front side of the first bonnet.

It is therefore another aspect, advantage, objective and embodiment of the present invention to provide a residential mailbox, further comprising: a second bonnet which may be interchanged with the first bonnet to be secured atop the columnar body, the second bonnet having a second letter delivery slot on a front side of the second bonnet, the second bonnet having at least one LED light.

It is therefore another aspect, advantage, objective and embodiment of the present invention to provide a residential mailbox, for use with letters, the residential mailbox further comprising: a slanted chute inside the residential mailbox, the slanted chute disposed so as to receive such letters entering the mailbox via the first letter delivery slot, the slant of the chute allowing such letters to slide into a first letter drawer.

It is therefore another aspect, advantage, objective and embodiment of the present invention to provide a residential mailbox, further comprising: the front door having at least one member extending from a bottom end of the front door inside of the columnar body; a box drawer disposed within the columnar body, resting upon the at least one member when the front door is in the closed position, whereby when the front door is opened, the box drawer is lifted upward and rotated out the front of the columnar body.

It is therefore yet another aspect, advantage, objective and embodiment of the present invention to provide a residential mailbox, further comprising: the columnar body have a back, the back having a back door therein, the back door forming part of the back when in a closed position, the back door having at least one hinge allowing it to move to an open position by swinging outward at a top end; the back door having at least one member extending from a bottom end of the back door inside of the columnar body, the member of the back door being disposed so that the member of the front door and the member of the back door do not occlude one another; whereby when the back door is opened, the box drawer is lifted upward and rotated out of the back of the columnar body.

It is therefore another aspect, advantage, objective and embodiment of the present invention to provide a residential mailbox, the residential mailbox comprising: a columnar body having a vertical axis and a front and a back; the front having a first door therein, the first door forming part of the front when in a closed position, the first door having at least one hinge allowing it to move to an open position by swinging outward at a top end; the first door having at least one member extending from a bottom end of the first door inside of the columnar body; a box drawer disposed within the columnar body, resting upon the at least one member when the first door is in the closed position, whereby when the first door is opened, the box drawer is lifted upward and rotated out the front of the columnar body.

It is therefore another aspect, advantage, objective and embodiment of the present invention to provide a residential mailbox, further comprising: the back having a second door therein, the second door forming part of the back when in a closed position, the second door having at least one hinge allowing it to move to an open position by swinging outward at a top end; the second door having at least one member extending from a bottom end of the second door inside of the columnar body, the member of the second door being disposed so that the member of the first door and the member of the second door do not occlude one another; whereby when the second door is opened, the box drawer is lifted upward and rotated out of the back of the columnar body.

It is therefore another aspect, advantage, objective and embodiment of the present invention to provide a residential mailbox, the first door having two side panels, the side panels concealed within the columnar body in the closed position, each side panel having a respective slot therethough, each slot being oriented at an angle to the vertical axis when the first door is in the closed position; an elastic member having two ends, each end having a respective fastener thereon, each fastener sliding within one slot whereby the elastic member is suspended loosely between the two slots and may move along the slots.

It is therefore another aspect, advantage, objective and embodiment of the present invention to provide a residential mailbox, the side panels further comprising: a relative angle between the front door and the side panels of slightly less than 90 degrees.

It is therefore another aspect, advantage, objective and embodiment of the present invention to provide a residential mailbox, further comprising: a first bonnet secured atop the columnar body, the first bonnet having a first letter delivery slot on a front side of the first bonnet.

It is therefore another aspect, advantage, objective and embodiment of the present invention to provide a residential mailbox, further comprising: a second bonnet which may be interchanged with the first bonnet to be secured atop the columnar body, the second bonnet having a second letter delivery slot on a front side of the second bonnet, the second bonnet having at least one LED light.

It is therefore another aspect, advantage, objective and embodiment of the present invention to provide a residential mailbox, for use with letters, the residential mailbox further comprising: a slanted chute inside the residential mailbox, the slanted chute disposed so as to receive such letters entering the mailbox via the first letter delivery slot, the slant of the chute allowing such letters to slide into a first letter drawer.

It is therefore another aspect, advantage, objective and embodiment of the present invention to provide a residential mailbox, for use with a first barcode, the residential mailbox further comprising: a second bonnet which may be interchanged with the first bonnet and be secured atop the columnar body, the second bonnet having a second letter delivery slot on a front side of the second bonnet; the second bonnet having within it a barcode scanner oriented to scan such first barcode when such first barcode is placed near the front side of the second bonnet; the first door having thereon a first solenoid, the first solenoid operative to open the first door when the barcode scanner scans such first barcode.

It is therefore another aspect, advantage, objective and embodiment of the present invention to provide a residential mailbox, further comprising: at least one LED light within the bonnet, the LED light disposed to illuminate the first letter drawer and the first box drawer; a camera operative to create an image of the first letter drawer and the first box drawer; a radio frequency connection operative to transmit the image.

It is therefore another aspect, advantage, objective and embodiment of the present invention to provide a residential mailbox, for use with a home safety system such as an elder care system or a home security system, the residential mailbox further comprising: at least one LED light disposed upon an exterior of the second bonnet; a radio frequency connection to such home safety system, such home safety system operative to activate the at least one LED light.

INDEX TO THE REFERENCE NUMERALS

Mailbox 100
Delivery door 102
Delivery aperture 104
Hinges 106*a*, 106*b*
Latch 108
Bonnet 110
House number 112
Flag 114
Letter chute 116
Letter drawer 118
Slanted slot 120
Fastener/rider 122
Base 124
Fingers (front door) 126
Fingers (rear door) 128
Column 130
Front door ass'y 202
Rear door ass'y 204
Frame members 206*a*, 206*b*
Side assemblies 208
Bonnet 210
Base assembly 212
Bottom 214
Box shelf 216
Letter drawer 218
Upper shelf 220
Letter chute 222
House number assembly 224
Slanted slot 226
Letter aperture 228
Fingers (front door) 230
Fingers (rear door) 232
Front door side panel 234
Rear door side panel 236
Mailbox 600
Front door ass'y open 602
Front door side panel 604
Box shelf (in front door) 606
Mailbox 700
Rear door ass'y open 702
Rear door side panel 704
Box shelf (on rear door) 706
Front door assembly 800
Front door side panel 802
Angled slot on side 806
Fastener 808
Elastic cord 810
Solenoid 812
Mailbox 900
Plain bonnet 902
Enhanced bonnet 904
Bonnet 1000
RF transceiver 1002
Barcode scanner 1004
LED light 1006
Internal camera 1008
External camera 1010
Controller 1012
NV memory 1014
Data bus 1016
Power lines 1018
Power supply 1020
Battery 1022
AC power 1024
Solar power 1026
Cellular module 1028
Verisign® module 1030
Voice in/out 1032
Screen/audio 1034
Text msg module 1036
Mailbox 1100
Security light 1102

Connection to home safety system 1104
360 view camera 1106
Solar power cell 1108
Bar code scanner 1110

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

FIG. 1 is a transparent front side view of the invention showing the front (delivery person) door and an aperture for depositing mail.

FIG. 2 is a transparent side view of the invention showing a house number and in partial transparency, details of the mail chute and return package holder of the invention.

FIG. 3 is an elevation perspective view of the mail box showing the top bonnet, front and side of the invention.

FIG. 4 is a bottom view of the invention showing details of the fingers on both front and back door which allow the box drawer in the bottom of the box to be lifted out by either door.

FIG. 5 is an exploded view of the components of the invention, including the front door, back door, sides, base parts, drawers, chute, bonnet, number sign and so on.

DETAILED DESCRIPTION OF DRAWINGS

Glossary

Figure 5:
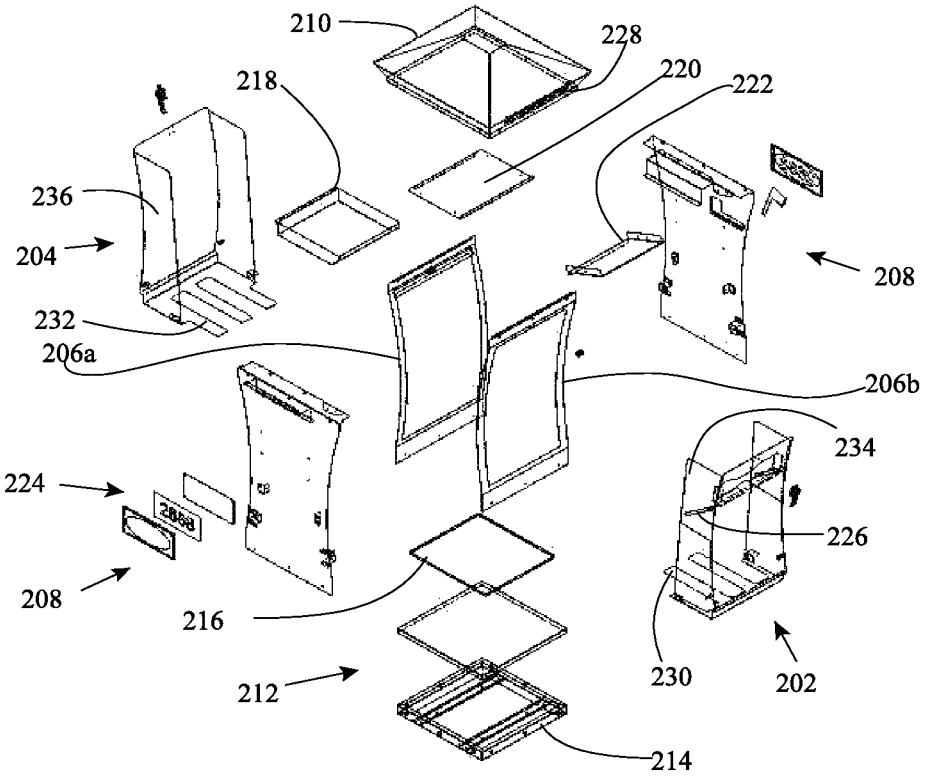

For purposes of this application and claims, the term slightly less than 90 degrees means an angle of 80 to 89.99 degrees.

For purposes of this application and claims, columnar means having the general aspect of a column e.g. being tall and narrow. In the presently preferred embodiments of the present invention, this includes being a generally rectanguloid body oriented with a vertical axis which is longer than the two horizontal axes.

An elastic member for purposes of this application and claims refers to items such as bungy cords, stretchable cords, rubber or polymer strings and cables, elastic bands such as are used in clothing and the like.

End Glossary

FIG. 1 is a transparent front side view of the invention showing the front (delivery person) door and an aperture for depositing mail, and FIG. 2 is a transparent side view of the invention showing a house number and in partial transparency, details of the mail chute and return package holder of the invention. FIG. 3 is an elevation perspective view of the mail box showing the top bonnet, front and side of the invention and FIG. 4 is a bottom view of the invention showing details of the fingers on both front and back door which allow the box drawer in the bottom of the box to be lifted out by either door.

a. Mailbox 100 has a generally rectangular columnar body 130 which narrows a bit near the middle. Delivery door 102 is also called the front door in this application, and with delivery aperture 104 is oriented toward the street, so that a delivery person in a vehicle can easily open either the door 102 or the aperture 104 and insert either a box (through the door 102) or a letter (through aperture 104).

b. One very important feature of the invention is that the pan in the bottom of the body which holds boxes and packages may be raised up and lifted toward either the front door or the back door upon opening. This, and equipment to allow easy access to a box by a delivery person seated in a vehicle (rather than getting out of their vehicle in the street) are much more important than the mere provision of two doors, and will be discussed in greater detail elsewhere.

Hinges 106*a*, 106*b* respectively serve the front door 102 and the owner's door, the back door, which faces away from the street so that the home owner may easily and safely open the mailbox without stepping into the street.

Latch 108 may be manual, keyed or keypad or combination or the like, or it may be automated, operated by an actuator such as a solenoid, and controlled by a bar code scanner or the like.

Bonnet 110 may be an important part of the invention. In particular, the invention may have a "basic" bonnet which is nothing more than a rain hat or roof to keep the elements out of the columnar body of the mailbox, or it may be an "enhanced" or upgraded bonnet having a solar cell and various electrical functionality described later, including lights and so on.

House number 112 may be seen to be a multi-layer structure and may have a glowing or light emitting background allowing the house number to be more easily seen in low-light conditions such as bad weather or night-time. The house number 112 may be present on one or both sides of the invention, and may also be present, in alternative embodiments, on the front or rear doors.

Flag 114 may be raised and lowered to indicate the presence of mail. However, there are better and more modern ways to indicate mail arrival, as discussed below.

Letter chute 116 is a generally smooth and slanted surface which is located just below the aperture 104, allowing letters to slide gently downward, and further into the columnar body toward the rear, until they land in letter drawer 118. It may be seen in later diagrams that letter drawer 118 slides out of the rear of the body when the rear door is opened, allowing the homeowner to obtain typical letter type mail without bending down.

Slanted slot 120 is located on the side panel of the front door, and carried in it fastener/rider 122, which in turn carries one end of an elastic cord, such as a thin "Bungy" cord or the like. A matching slanted slot and rider on another side panel of the front door carry the other end of the cord. The cord may be used to retain a package to be returned, that is, a package which the homeowner has placed in the box for the delivery person to pick up. (This happens for example when an online product is returned.) When the elastic cord is placed around a returned package, the package will cling to the interior of the front door 102. When the front/delivery door 102 is opened, the package will be carried forward toward the delivery person, making it easier for the delivery person to pick up the box. The fingers on the front door 126 (seen in FIG. 4), will also lift up a pan in the bottom of the column 130 so that the returned package will be lifted from the bottom as well.

Base 124 may be materials designed to withstand contact with the ground, such as stainless steel or the like.

Fingers (front door) 126 and fingers (rear door) 128 will both lift the same pan from the bottom of the columnar body 130 toward whichever direction the box is opened from. Thus if the homeowner opens the rear door, the pan is lifted toward the rear, but if the delivery person opens the front door, the same pan is lifted toward the front.

FIG. 5 is an exploded view of the components of the invention, including the front door, back door, sides, base parts, drawers, chute, bonnet, number sign and so on. Front door ass'y 202 has two side panels (which are not the same as the side assemblies (208)). The front door assembly 202 carries an elastic member in two slanted slots 226 in the sides of the front door. The front door sides may be not quite parallel but may slant inward just a very small amount, a few degrees. This in turns mean that when the elastic cord is pulled outward by a someone putting a package into the elastic, the elastic cord ends (on small riders in the slanted slots 226) are pulled to parts of the side panels which are closer, loosening the elastic and making removal or insertion of the package easier.

Rear door ass'y 204 and the front door 202 fit between frame members 206*a*, 206*b* and then with side assemblies 208 forms the columnar body Bonnet 210 is interchangeable without disturbing other structures of the invention. Thus one bonnet 210 may be removed without any other part of the columnar body being removed, then the bonnet 210 may be replaced with another bonnet.

Base assembly 212 is designed to be seated either directly into the earth or into a foundation of some type, without excessive degradation, rust or rot. Bottom 214 does not hold box shelf 216 directly, rather, the front door fingers 230 and the rear door fingers 232 actually hold the box shelf 216. When either door is opened, that set of fingers then raise the box shelf along with any parcel sitting on the bottom of the box, and turn it while moving it sideways toward the direction of the door being opened: at the end of the door's swing, the package on the box shelf 216 will actually be largely outside of the columnar body.

Letter drawer 218 on the other hand is designed in the best mode now contemplated and presently preferred embodiment to slid out only toward the rear when the rear door is opened. (Letters are only deposited from the front, via aperture 228).

Upper shelf 220 holds the letter drawer 218.

Letter chute 222 gently slides anything deposited in letter aperture 228 down to the letter drawer 218.

House number assembly 224 may include a glowing back panel to that the numbers of the home are more clearly visible in low light.

Front door side panel 234 carries on it the slanted slot which in turn carries the rider, which in turn is attached to the end of an elastic cord.

Rear door side panel 236 on the other hand may not have these parts, in embodiments.

Figure 6:
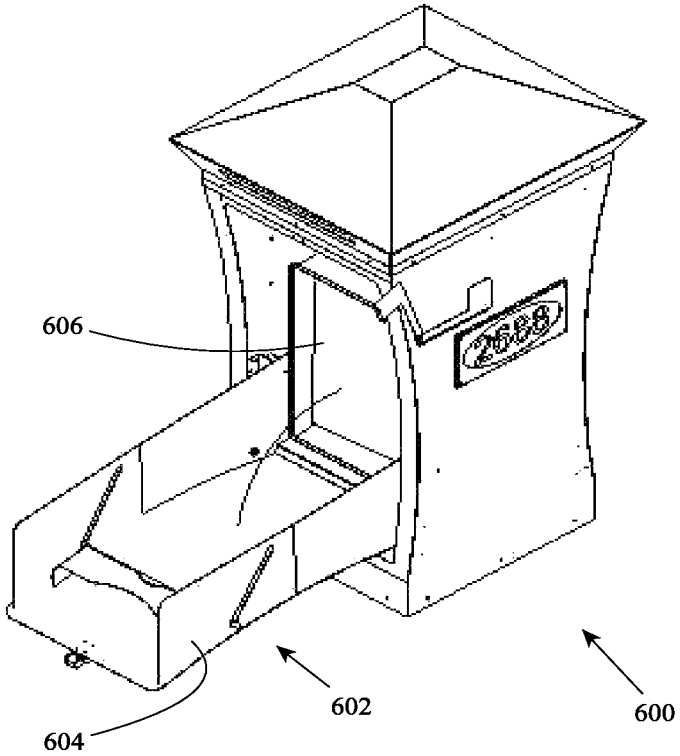
FIG. 6 is a non-transparent side view of the box of the invention with the front door open, showing the box shelf lifted by the fingers of the front door.

FIG. 6 is a non-transparent side view of the box of the invention with the front door open, showing the box shelf lifted by the fingers of the front door.

Mailbox 600 is shown with the front door ass'y 602 open. It may immediately be seen that the box shelf 606 and the front door side panel 604 will push any package which was sitting in the box shelf 606 to the center of the front door and further will push it outward from the columnar body and closer to the door opener. This is true even if the elastic cord stretched between the slanted slots is not used to hold the package.

Box shelf 606 is depicted here in a rather "tray-like" shape, however, the preferred embodiment is not necessarily like this: the tray shape is obviously easier to see at the angle of this view.

Figure 7:
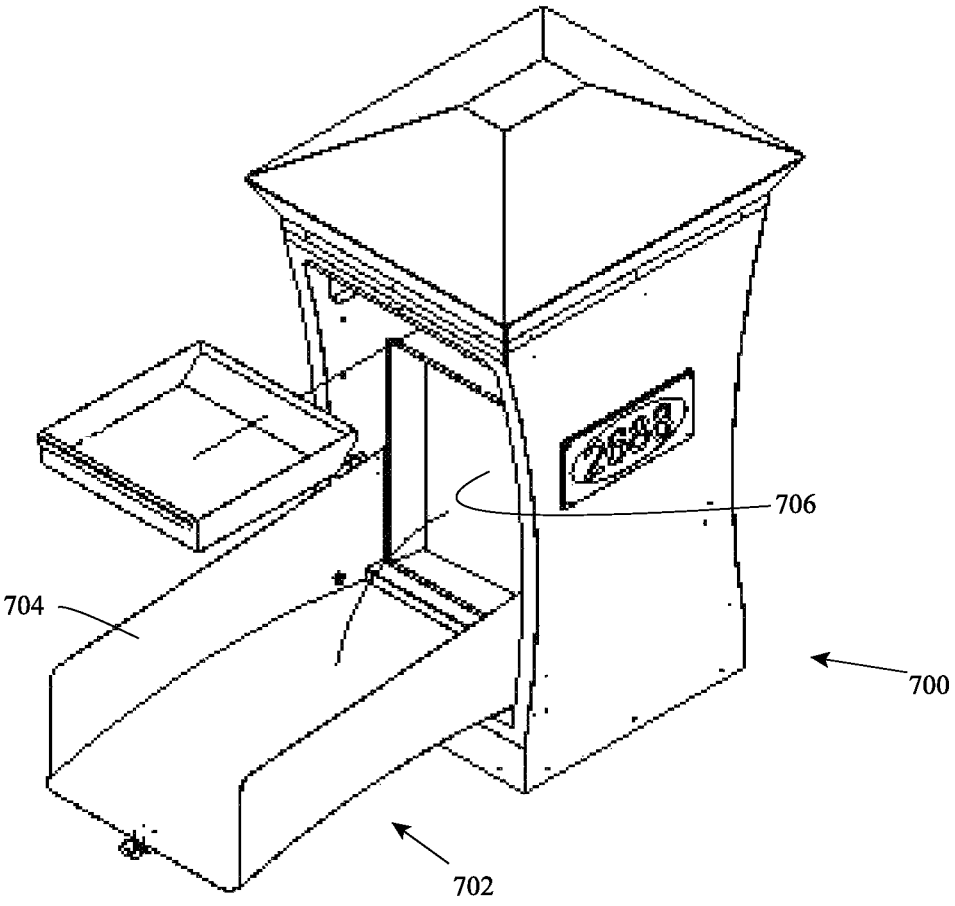
FIG. 7 is a non-transparent side view of the box of the invention with the back door open, showing the same box shelf is now lifted by the fingers of the back door.

FIG. 7 is a non-transparent side view of the box of the invention with the back door open, showing the same box shelf is now lifted by the fingers of the back door.

Mailbox 700 is shown with the rear door assembly 702 open, which can be carefully contrasted with the previous view (FIG. 6). It may immediately be seen in this FIG. 7 that the box shelf 706 and the rear door side panel 704 will serve like fences or rails and push any package which was sitting in the box shelf 706 to the rear door interior and further will push it outward from the columnar body and closer to the individual opening the door. Note that in presently preferred embodiments the rear door 702 has no elastic cord, slanted slots, etc.

Box shelf 706 is again depicted here in a rather "tray-like" shape, however, the preferred embodiment is not necessarily like this: the tray shape is obviously easier to see at the angle of this view. The box shelf may be flat just as easily.

Figure 8:
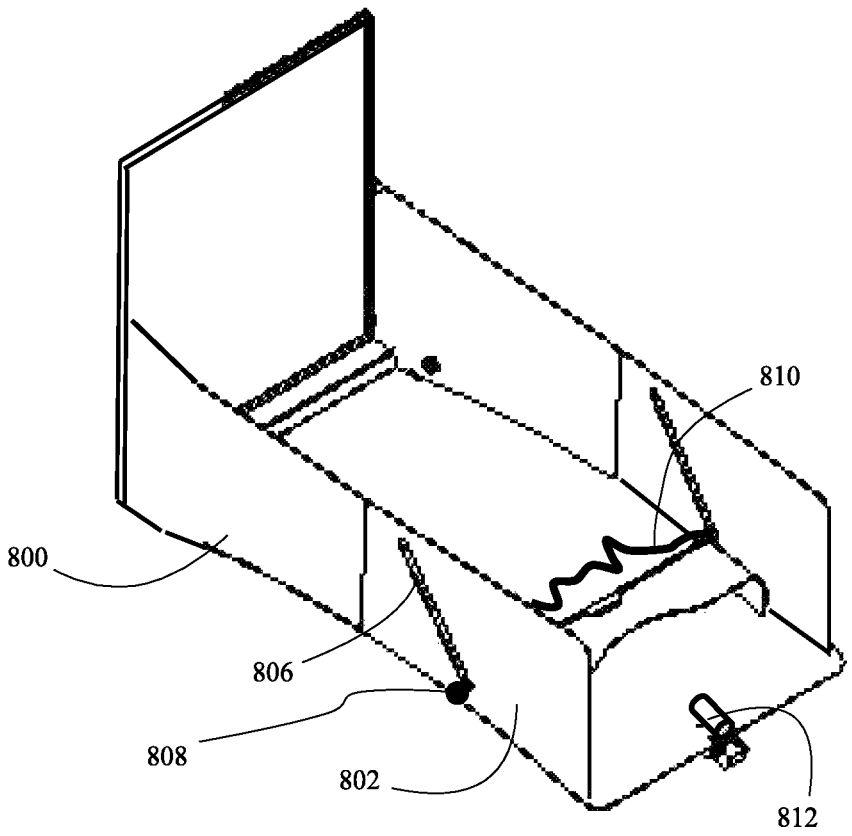
FIG. 8 is a view of the front door assembly, including not just the one-piece front door but also the two angled slots on the door side panels, the bungy cord and the fasteners holding the bungy cord to the slots.

FIG. 8 is a view of the front door assembly, including not just the one-piece front door but also the mail chute and aperture, the two angled slots on the door side panels, the bungy cord and the fasteners holding the bungy cord to the slots, all of which together comprise the convenience features for a delivery person accepting a returned package from the box.

Front door assembly 800 has front door side panel 802 which in turn has angled slot 806. The angled slot 806 has a rider/fastener 808 (rather like the aglet of a shoelace but wider) therein which prevents the end of the elastic cord 810 from coming free, but which allows the elastic cord and rider to move back and forth along the slot. Note that the side panel 802 is not quite perpendicular to the front door itself, rather the side panels may be slanted toward one another just a bit so that when the rider moves along the slot toward the edge of the panel, some slack is generated in the elastic cord.

Solenoid 812 is depicted in this embodiment as being on the door, but it may also be on the bonnet to make for easy retrofitting. The solenoid 812 may automatically open the door or unlock the door when a scanner indicates the presence of the correct bar code, or a keypad combination is entered corrected, a text message is received, and so on.

Figure 9:
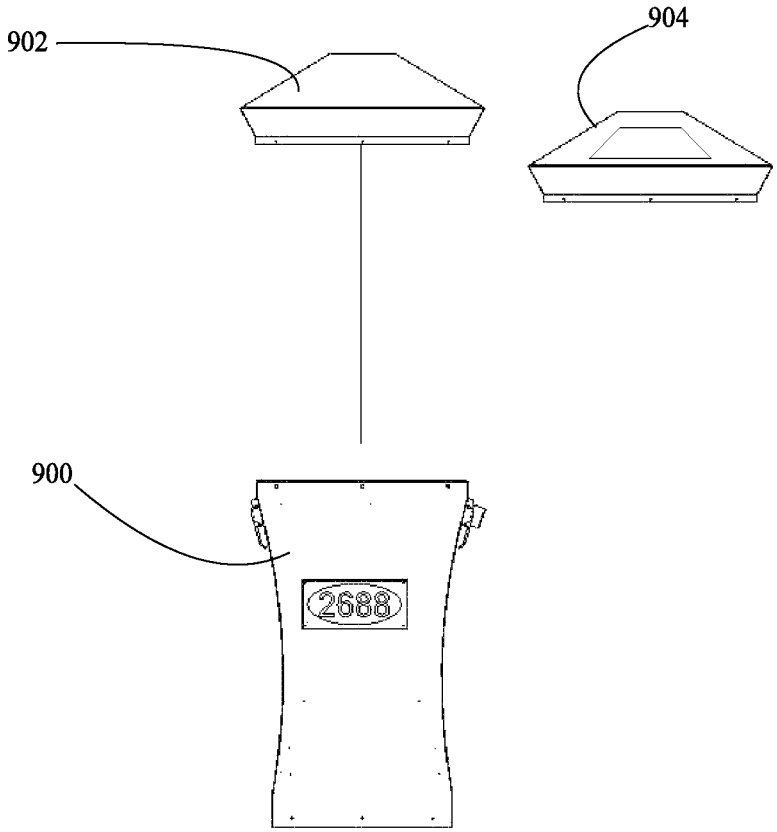
FIG. 9 is a view of the assembled box similar to FIG. 3, but showing that optionally a second interchangeable bonnet may be provided as part of the invention.

FIG. 9 is a view of the assembled box similar to FIG. 3, but showing that optionally a second interchangeable bonnet may be provided as part of the invention.

Mailbox 900 may have both a plain bonnet 902 and an enhanced bonnet 904 which may be sold together with the device, or may be sold separately. In one mode of employment, the device may be sold to a developer with the basic bonnet only, while the homeowners may then be offered the option to buy the enhanced bonnet. Either way, it is possible to remove either bonnet without disturbing the overall structure or the columnar body, and replace it. If solar power is used and wireless communication, and if the front door solenoid is located in the bonnet rather than the door, then no wiring work at all need be done to carry out the retrofit.

Figure 10:
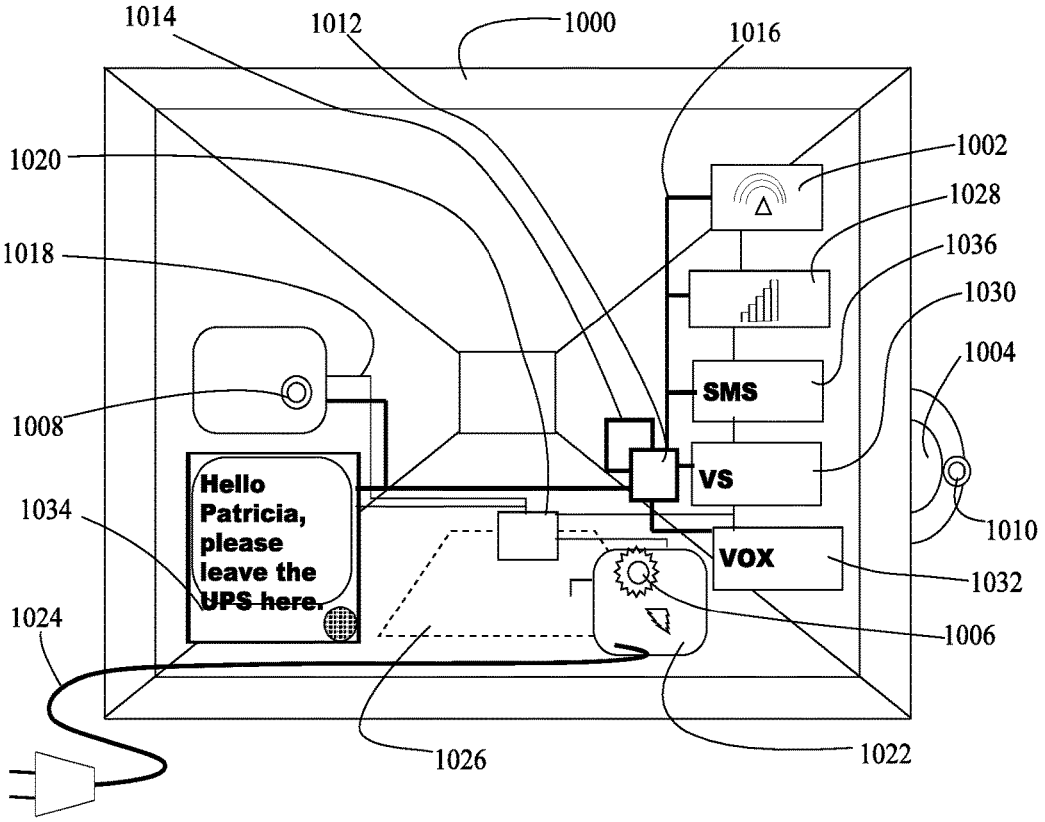
FIG. 10 is an underside view of a bonnet having electrical features including an internal light, internal and external cameras, a bar code scanner and supporting equipment.

FIG. 10 is an underside view of a bonnet having electrical features including an internal light, internal and external cameras, a bar code scanner and supporting equipment. Bonnet 1000 may have therein an RF transceiver 1002 such as might be used with Bluetooth® or Wifi® applications or with longer range (such as citizen's band). By this means, or by means of cellular service module 1028, or a data hardwire, it may communicate with the owner's mobile devices (such as telephones) and equally importantly, it may communicate with home safety services such as home security systems or LifeAlert®, which monitors people with dangerous conditions. In addition, it may provide a security camera useful for the homeowner to see not only who is accessing their mailbox and also to view the area about the mailbox, up and down the street, and so on.

Barcode scanner 1004 is one of the most innovative features of the present invention. When a buyer wishes to return an online purchase, the buyer usually prints out, from the seller, a mailing label having a barcode. The buyer places the mailing label on the package and then the mailing charge is paid by the seller. In the present invention, the buyer may furthermore communicate the mailing label to the mail delivery person, for example, by emailing an image of the mailing label with it's barcode. The homeowner/buyer may then inform the advanced mailbox of the present invention (with the enhanced bonnet) of the barcode number, and place the labeled package into the mailbox, presumably using the elastic cord on the delivery person's door. When the delivery person comes to the box, they scan the barcode they have printed out, which the mailbox recognizes and based on that bar code, the mailbox activates the actuator which opens the front door so the mailperson may retrieve the package.

LED light 1006 may illuminate the interior of the mailbox so that internal camera 1008 may show the homeowner, via cellular module 1028 or RF 1002 (for example sending a text or MMS message including a photo or video) the contents of the box.

External camera 1010 on the other hand, like the 360 camera discussed previously, may show the surroundings of the box: the person accessing the box, the street, the front yard etc.

Controller 1012 and non-volatile memory 1014 will be understood to provide control over the functions of the advanced bonnet, by way of data bus 1016 and/or power lines 1018.

Power supply 1020 may distribute power and in embodiments may control power sources, for example, switching to receiving power from solar power cell 1026 when it is generating electricity or switching to the battery 1022 when solar power is unavailable. Note that various combinations of these three power supplies mean that depending on embodiment, any could become optional.

Verisign® module 1030 would be an example of the manner in which the mailbox could cooperate with electronic signature systems to allow access to the box, and another potential method would be voice input/output 1032 (allowing speech recognition or simply use as a call box via screen/audio 1034).

Text message module 1036 could allow the device to send notifications to the user via cell service module 1028: the text module 1036 may format the messages, use the camera to take photos, select from various pre-supplied text messages and so on and so forth.

Figure 11:
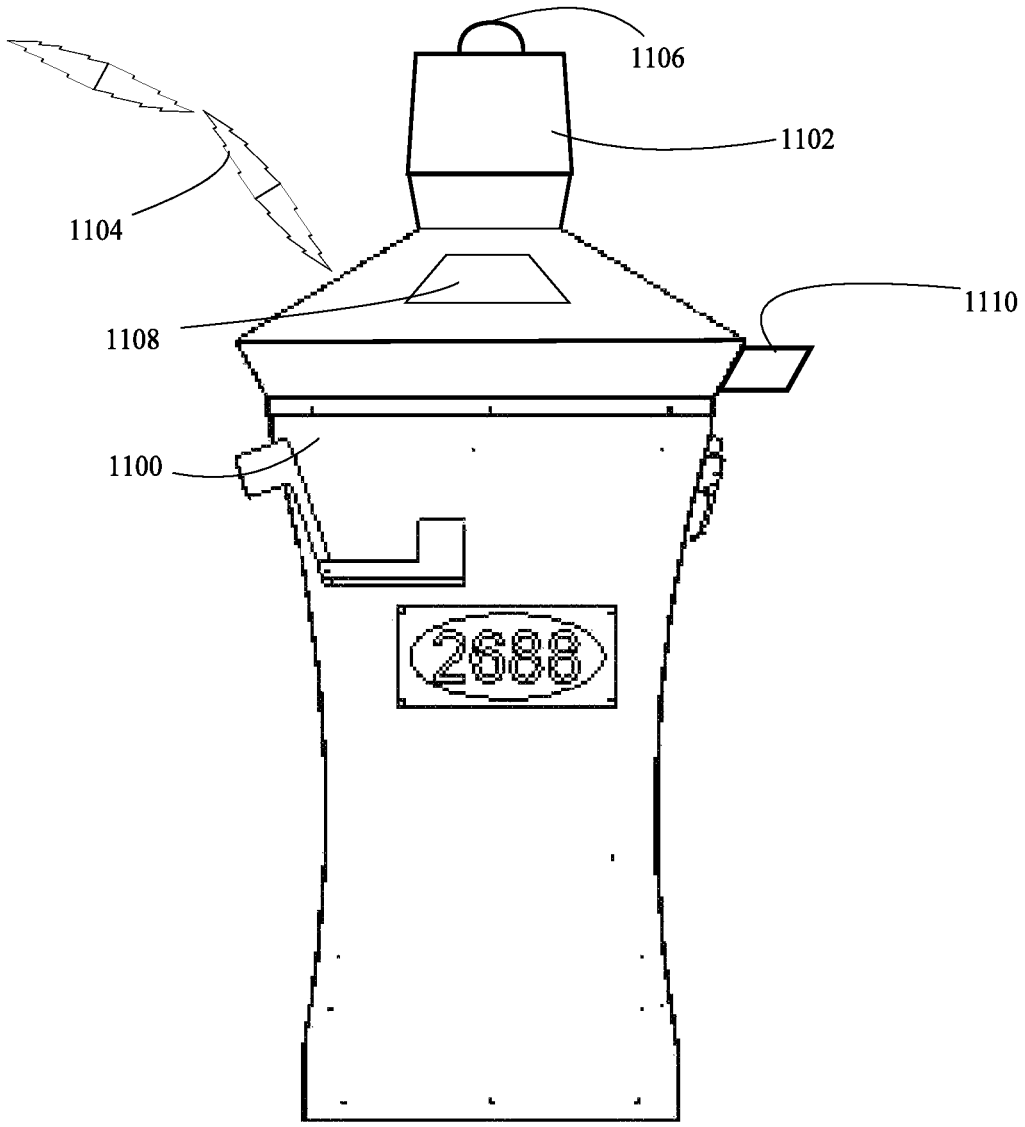
FIG. 11 is a picture of an assembled box similar to FIG. 3 but also showing the security warning and identification lights and an RF connection to a home security/medical system.

FIG. 11 is a picture of an assembled box similar to FIG. 3 but also showing the security warning and identification lights and an RF connection to a home security/medical system.

Mailbox 1100 has a security light 1102 atop it. Note that in this simplified representation the light is depicted rather like an old-fashioned police car spinning light, however it is more likely that the light preferred will be LED, may be mounted to one side, and is likely to be shaped considerably more esthetically.

Connection to home safety system 1104 may be wireless, and may be wifi or other short range radio, may be cellular service, or may be wired.

360 view camera 1106 may be replaced with a remote controlled camera, may be replaced with multiple cameras facing different directions, etc. It is shown enclosed in a weather protective bubble.

Solar power cell 1108 frees the device from wired power.

Bar code scanner 1110, as discussed previously, allows the device to be pre-programmed on a daily basis or as-needed basis to open when a particular bar-code/QR code is presented to the scanner.

Throughout this application, various publications, patents, and/or patent applications are referenced in order to more fully describe the state of the art to which this invention pertains. The disclosures of these publications, patents, and/or patent applications are herein incorporated by reference in their entireties, and for the subject matter for which they are specifically referenced in the same or a prior sentence, to the same extent as if each independent publication, patent, and/or patent application was specifically and individually indicated to be incorporated by reference.

Methods and components are described herein. However, methods and components similar or equivalent to those described herein can be also used to obtain variations of the present invention. The materials, articles, components, methods, and examples are illustrative only and not intended to be limiting.

Although only a few embodiments have been disclosed in detail above, other embodiments are possible and the inventors intend these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art.

Having illustrated and described the principles of the invention in exemplary embodiments, it should be apparent to those skilled in the art that the described examples are illustrative embodiments and can be modified in arrangement and detail without departing from such principles. Techniques from any of the examples can be incorporated into one or more of any of the other examples. It is intended that the specification and examples be considered as exemplary only, with a true scope and spirit of the invention being indicated by the following claims.

What is claimed is:

1. A residential mailbox comprising:

a columnar body having a vertical axis and a front;

the front having a front door therein, the front door forming part of the front when in a closed position, the front door having at least one hinge allowing it to move to an open position by swinging outward at a top end;

the front door having two side panels, the side panels concealed within the columnar body in the closed position, each side panel having a respective slot therethough, each slot being oriented at an angle to the vertical axis when in the closed position;

an elastic member having two ends, each end having a respective fastener thereon, each fastener sliding within one slot whereby the elastic member is suspended loosely between the two slots and moves along the slots.

2. The residential mailbox of claim 1, the side panels further comprising:

a relative angle between the front door and the side panels of slightly less than 90 degrees.

3. The residential mailbox of claim 1, further comprising:

a first bonnet secured atop the columnar body, the first bonnet having a first letter delivery slot on a front side of the first bonnet.

4. The residential mailbox of claim 3, further comprising:

a second bonnet which may be interchanged with the first bonnet to be secured atop the columnar body, the second bonnet having a second letter delivery slot on a front side of the second bonnet, the second bonnet having at least one LED light.

5. The residential mailbox of claim 3, further comprising:

a slanted chute inside the residential mailbox, the slanted chute disposed so as to receive letters entering the mailbox via the first letter delivery slot, the slant of the chute allowing the letters to slide into a first letter drawer.

6. The residential mailbox of claim 3, further comprising:

the front door having at least one member extending from a bottom end of the front door inside of the columnar body;

a box drawer disposed within the columnar body, resting upon the at least one member when the front door is in the closed position, a center of gravity of the box drawer disposed on the at least one member of the front door, whereby the at least one member of the front door provides stable support for the box drawer.

7. The residential mailbox of claim 6, further comprising:

the columnar body have a back, the back having a back door therein, the back door forming part of the back when in a closed position, the back door having at least one hinge allowing it to move to an open position by swinging outward at a top end;

the back door having at least one member extending from a bottom end of the back door inside of the columnar body, the member of the back door being disposed so that the member of the front door and the member of the back door do not occlude one another;

the center of gravity of the box drawer further disposed on the at least one member of the rear door, whereby the at least one member of the rear door provides stable support for the box drawer.

8. A residential mailbox for use with boxes, the residential mailbox comprising:

a columnar body having a vertical axis and a front and a back;

the front having a first door therein, the first door forming part of the front when in a closed position, the first door having at least one hinge allowing it to move to an open position by swinging outward at a top end;

the first door having at least one member extending from a bottom end of the first door inside of the columnar body;

a box drawer disposed within the columnar body, resting upon the at least one member when the first door is in the closed position, a center of gravity of the box drawer disposed on the at least one member of the front door, whereby the at least one member of the front door provides stable support for the box drawer.

9. The residential mailbox of claim 8, further comprising:

the back having a second door therein, the second door forming part of the back when in a closed position, the second door having at least one hinge allowing it to move to an open position by swinging outward at a top end;

the second door having at least one member extending from a bottom end of the second door inside of the columnar body, the member of the second door being disposed so that the member of the first door and the member of the second door do not occlude one another;

the center of gravity of the box drawer further disposed on the at least one member of the rear door, whereby the at least one member of the rear door provides stable support for the box drawer.

10. The residential mailbox of claim 9, the first door having two side panels, the side panels concealed within the columnar body in the closed position, each side panel having a respective slot therethough, each slot being oriented at an angle to the vertical axis when the first door is in the closed position;

an elastic member having two ends, each end having a respective fastener thereon, each fastener sliding within one slot whereby the elastic member is suspended loosely between the two slots and moves along the slots.

11. The residential mailbox of claim 10, the side panels further comprising:

a relative angle between the front door and the side panels of slightly less than 90 degrees.

12. The residential mailbox of claim 9, further comprising:

a first bonnet secured atop the columnar body, the first bonnet having a first letter delivery slot on a front side of the first bonnet.

13. The residential mailbox of claim 12, further comprising:

a second bonnet which may be interchanged with the first bonnet to be secured atop the columnar body, the second bonnet having a second letter delivery slot on a front side of the second bonnet, the second bonnet having at least one LED light.

14. The residential mailbox of claim 13, further comprising:

a slanted chute inside the residential mailbox, the slanted chute disposed so as to receive letters entering the mailbox via the first letter delivery slot, the slant of the chute allowing the letters to slide into a first letter drawer.

15. The residential mailbox of claim 12, for use with a first barcode, the residential mailbox further comprising:

a second bonnet which may be interchanged with the first bonnet and be secured atop the columnar body, the second bonnet having a second letter delivery slot on a front side of the second bonnet;

the second bonnet having within it a barcode scanner oriented to scan such first barcode when such first barcode is placed near the front side of the second bonnet;

the first door having thereon a first solenoid, the first solenoid operative to open the first door when the barcode scanner scans such first barcode.

16. The residential mailbox of claim 13, further comprising:

at least one LED light within the bonnet, the LED light disposed to illuminate the first letter drawer and the first box drawer;

a camera operative to create an image of the first letter drawer and the first box drawer;

a radio frequency connection operative to transmit the image.

17. The residential mailbox of claim 13 for use with a home safety system, the residential mailbox further comprising:

at least one LED light disposed upon an exterior of the second bonnet;

a radio frequency connection to the home safety system, the home safety system operative to activate the at least one LED light.

* * * * *